US006160390A

United States Patent [19]

Gheeraert et al.

[11] Patent Number: 6,160,390

[45] Date of Patent: Dec. 12, 2000

[54] METHOD AND APPARATUS FOR ERROR CURRENT COMPENSATION

[76] Inventors: Manuel R. Gheeraert, 16 Royal Crest Dr., Apt. 3, Nashua, N.H. 03060; Jeffrey B. Van Auken, 30 Nashoba Trail, Littleton, Mass. 01460; Alex Gusinov, 51 Taft Ave., Lexington, Mass. 02173

[21] Appl. No.: 09/494,326

[22] Filed: Jan. 28, 2000

[51] Int. Cl.[7] ..... G05F 3/04

[52] U.S. Cl. ..... 323/312; 323/315

[58] Field of Search ..... 323/315, 314, 323/313, 312

[56] References Cited

U.S. PATENT DOCUMENTS 5,512,816 4/1996 Lambert ..... 323/315

5,625,281 4/1997 Lambert ..... 323/315

*Primary Examiner*—Shawn Riley

[57] ABSTRACT

A method and circuit for error current compensation is presented. The method includes the steps of generating a first current and an associated error current, generating a second current and an associated error current substantially equal to the first current and the first error current, respectively, and generating a third current substantially equal to the first current. The method includes the additional steps of extracting the second error current from the second current, generating a multiplied current equal to the scaled error current plus a multiplier error current, and combining the multiplied current with the first current and first error current.

The circuit for error current compensation includes a first, second and third current source, a multiplier, and a first and second subtractor. The first subtractor provides a first difference current equal to the difference of a second current and second error current generated by the second current source and a third current generated by the third current source. The multiplier generates a predetermined multiple of the second error current and a multiplier error current at its output terminal. The second subtractor provides a second difference current at its output equal to the difference of the predetermined multiple of the second error current and a multiplier error current from the output of the multiplier and a first current and first error current generated by the first current source. The second difference current is substantially equal to the first current from the first current source.

9 Claims, 4 Drawing Sheets

METHOD AND APPARATUS FOR ERROR CURRENT COMPENSATION

FIELD OF THE INVENTION

The invention relates to the field of current regulators and more specifically to a method of compensating for an error current.

BACKGROUND OF THE INVENTION

Semiconductor devices often require accurate current sources to perform various electronic functions such as biasing, current amplification and timing. An ideal current source has a high output impedance, stable temperature operation and wide supply voltage compliance. One such device is a charge pump voltage converter. By using a capacitor as energy transferring element, a charge pump voltage converter produces an output voltage that is a multiple of its input voltage. For example, charge pump converters can convert a 5 volt input to a 10 volt output, a −5 volt output or a −10 volt output. These charge pump devices are often required to work over a wide input voltage range, thus the total voltage seen by the power supply of such devices varies substantially. Metal oxide semiconductor field effect transistors (MOSFETs) are used in such charge pump devices due to their excellent performance as a switching or logic element when the gate of the MOSFET is driven with a rail to rail logic signal. However, when a MOSFET is driven by a low gate voltage, it can exhibit excessive error current making it an unsatisfactory current source.

SUMMARY OF THE INVENTION

The invention relates to a method and apparatus for compensating for an error current generated by a current source.

In one embodiment the method includes the steps of generating a first current and an associated error current, generating a second current and an associated error current substantially equal to the first error current, and generating a third current substantially equal to the first error current. The method includes the additional steps of extracting the second error current from the second current, generating a multiplied current substantially equal to the scaled error current plus a multiplier error current, and combining the multiplied current with the first current and first error current. In another embodiment the step of combining includes subtracting the multiplied current from the first current and first error current.

In one embodiment the circuit includes a first current source having an output terminal; a second current source having an output terminal; a third current source having an output terminal; a multiplier having an input terminal and an output terminal; a first subtractor having a first and a second input terminal, and an output terminal; and a second subtractor having a first and a second input terminal, and an output terminal. The first and second input terminals of the first subtractor are in electrical communication with the output terminals of the second current source and the third current source, respectively. The input terminal of the multiplier is in electrical communication with the output terminal of the first subtractor. The first and second input terminals of the second subtractor are in electrical communication with the output terminal of the first current source and the output terminal of the multiplier, respectively. The first subtractor provides a first difference current substantially equal to the difference of a second current and second error current generated by the second current source and a third current generated by the third current source. The multiplier generates a predetermined multiple of the second error current and a multiplier error current at its output terminal. The second subtractor provides a second difference current at its output substantially equal to the difference of the predetermined multiple of the second error current and a multiplier error current from the output of the multiplier and a first current and first error current generated by the first current source. The second difference current is substantially equal to the first current from the first current source.

In one embodiment the third current source includes a clamped MOSFET device preventing generation of an error current at the output terminal of the third current source. In another embodiment the second subtractor includes a cascode device. In yet another embodiment the multiplier includes multiple components having respective device sizes and the predetermined multiple of the second error current is determined in response to the device sizes.

DESCRIPTION OF THE PREFERRED EMBODIMENT

Figure 1:
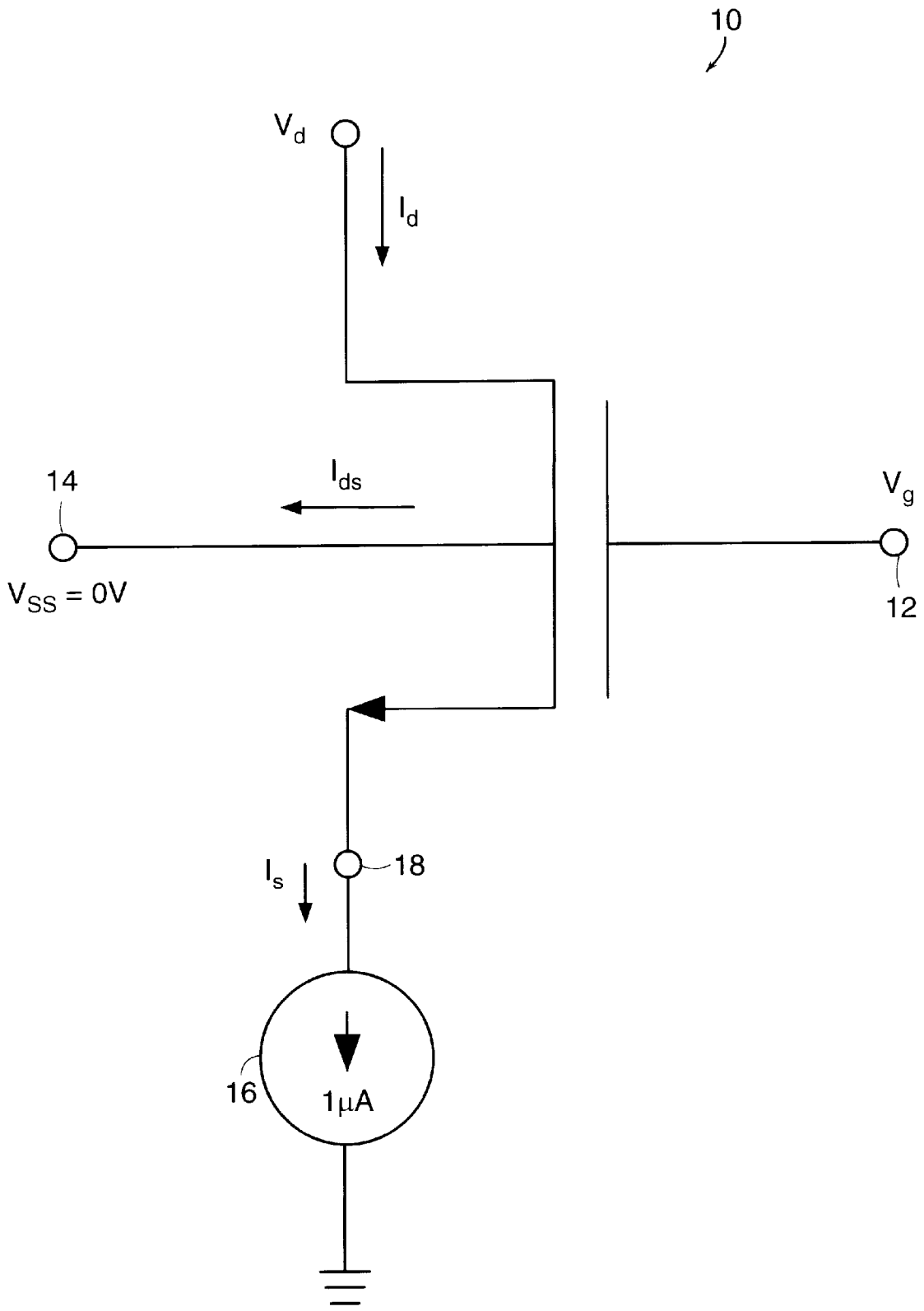
FIG. 1 PRIOR ART
FIG. 1 is a schematic diagram of an embodiment of a MOSFET device coupled to a constant current source at its source terminal as known to the prior art.

Referring to FIG. 1, the drain current Id of an N-channel MOSFET 10 is controlled by a voltage Vg applied to its gate 12. The back gate 14 of the MOSFET 10 is typically held at the substrate voltage (Vss=0 volts). Ideally, the MOSFET 10 is an extended compliance device such that the drain current Id is equal to the current Is supplied by the current source 16 for any gate voltage Vg above the turn on voltage of the MOSFET 10. However, a gate modulated breakdown occurs for low gate voltages Vg resulting in a substantial current flowing from the drain to the substrate. Thus Id can be substantially larger than the current Is supplied by the current source 16.

Figure 2:
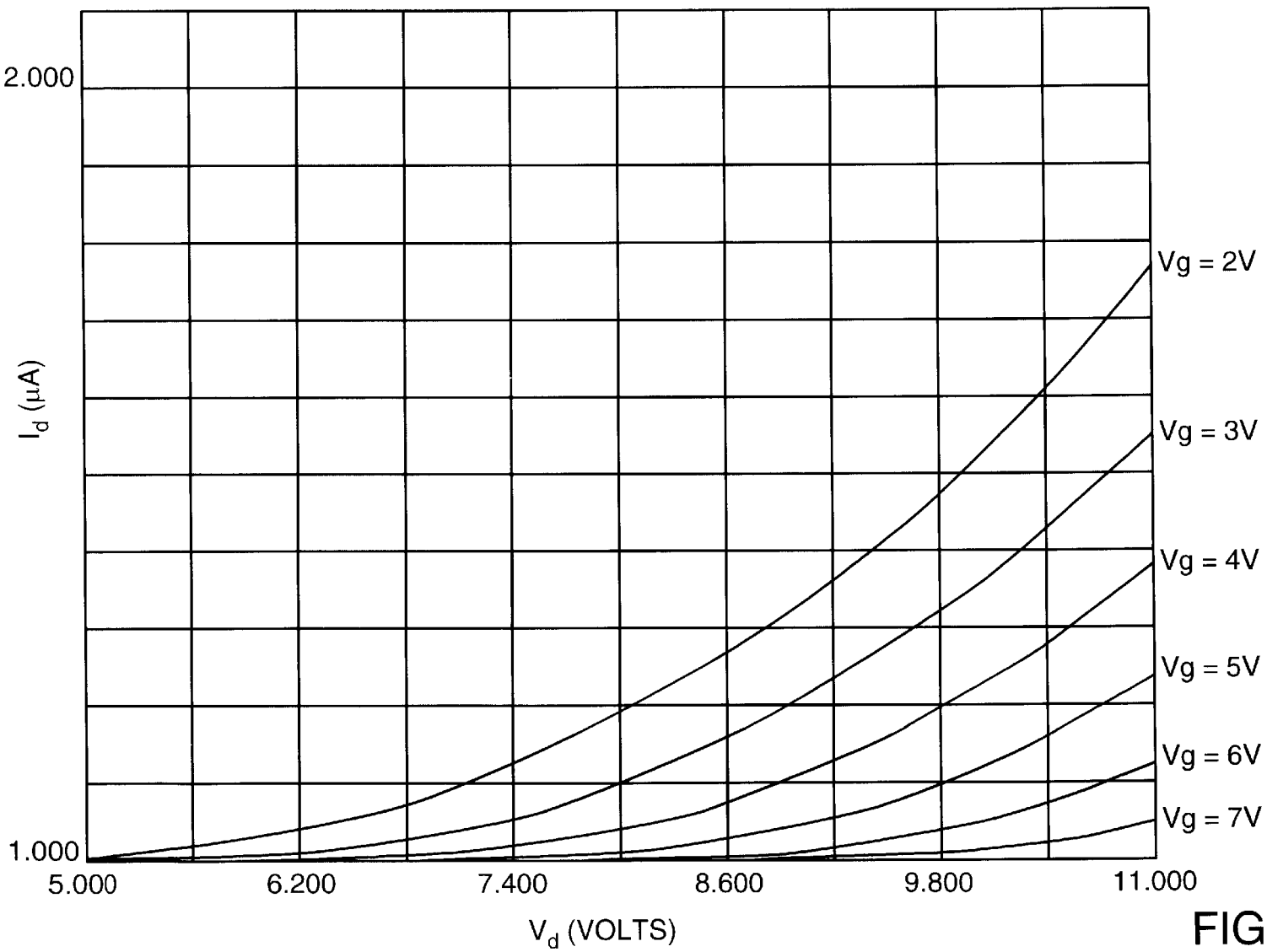
FIG. 2 is a graphical representation of the drain current for the MOSFET device of FIG. 1 operated at different gate voltages.

For example, a MOSFET 10 with its source 18 connected to a 1 $\mu$A current source 16 and a drain voltage Vd of 10.4 volts has a drain current Id of 1.02 $\mu$A when the gate voltage Vg is 7.0 volts as depicted in FIG. 2. If the gate voltage Vg is only 2.0 volts, however, the drain current Id is 1.6 $\mu$A (i.e., the error current represents an additional current of 60% of the source current Is).

Figure 3:
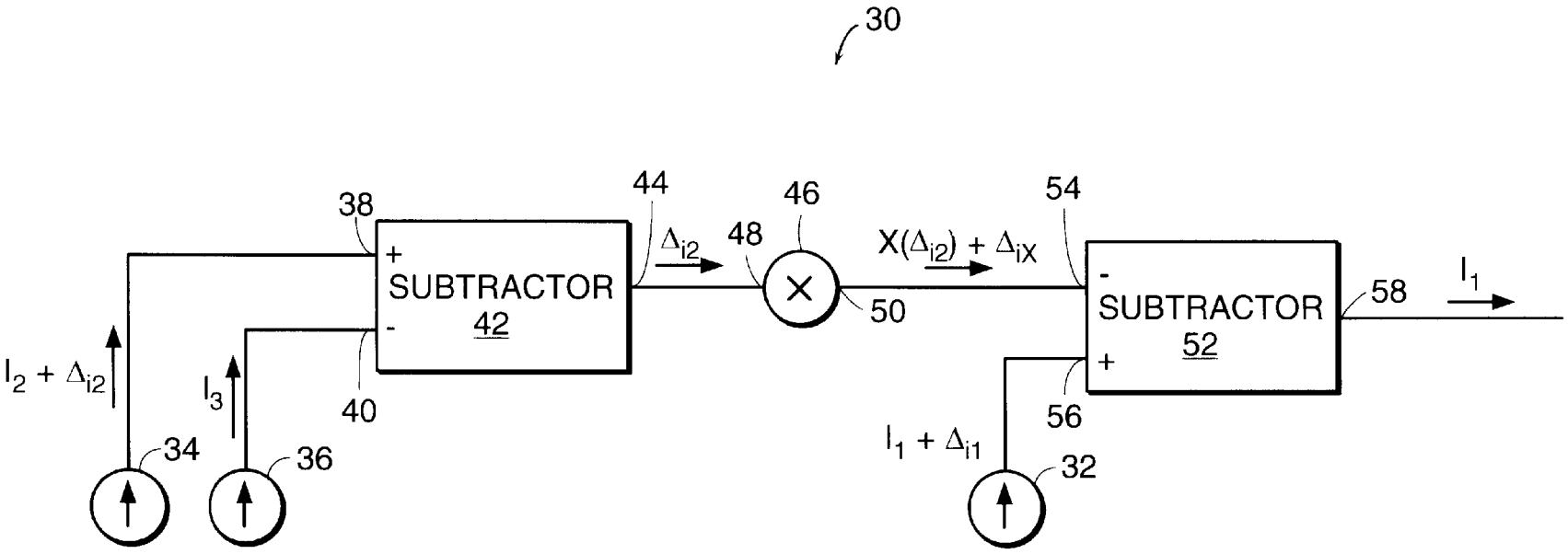
FIG. 3 is a functional block diagram of an embodiment of a circuit constructed in accordance with the invention.

A functional block representation of one embodiment of the circuit of the present invention is shown in FIG. 3. The circuit 30 includes a first current source 32 which generates a current $I_1$ and an error current $\Delta i_1$, a second current source 34 which generates a current 12 and an error current $\Delta i_2$, and a third current source 36 which generates a current 13. The second current source 34 and the third current source 36 are coupled to the positive and negative inputs, 38 and 40, respectively, of a first subtractor unit 42. The first subtractor unit 42 provides a difference output current $\Delta i_2$ at its output terminal 44.

A multiplier unit 46 has an input terminal 48 coupled to the output terminal 44 of the first subtractor 42. The multiplier unit 46 generates a multiplier current $X(\Delta i_2)+\Delta i_x$ at its output terminal 50 which includes two current components: a scaled current $X(\Delta i_2)$ and an error current $\Delta i_x$. The magnitude of the scaled current $X(\Delta i_2)$ is X times the magnitude of the current received at multiplier input terminal 48. A second subtractor unit 52 receives the multiplier current $X(\Delta i_2)+\Delta i_x$ at its negative input terminal 54 and the current $I_1+\Delta i_1$ from the first current source 32 at its positive input terminal 56. The second subtractor unit 52 generates a current at its output terminal 58 which is the difference of the currents $I_1+\Delta i_1$ and $X(\Delta i_2)+\Delta i_x$ at its input terminals 54 and 56, respectively.

If the multiplier current $X(\Delta i_2)+\Delta i_x$ is equal to the error current $\Delta i$ generated by the first current source 32, the output of the second subtractor 52 is the desired stable current $I_1$. Thus the multiplier unit 46 is designed with components having the proper device sizes to realize the necessary scale factor X to compensate for the first error current $\Delta i_1$ and the error current $\Delta i_x$ of the multiplier unit 46.

Figure 4:
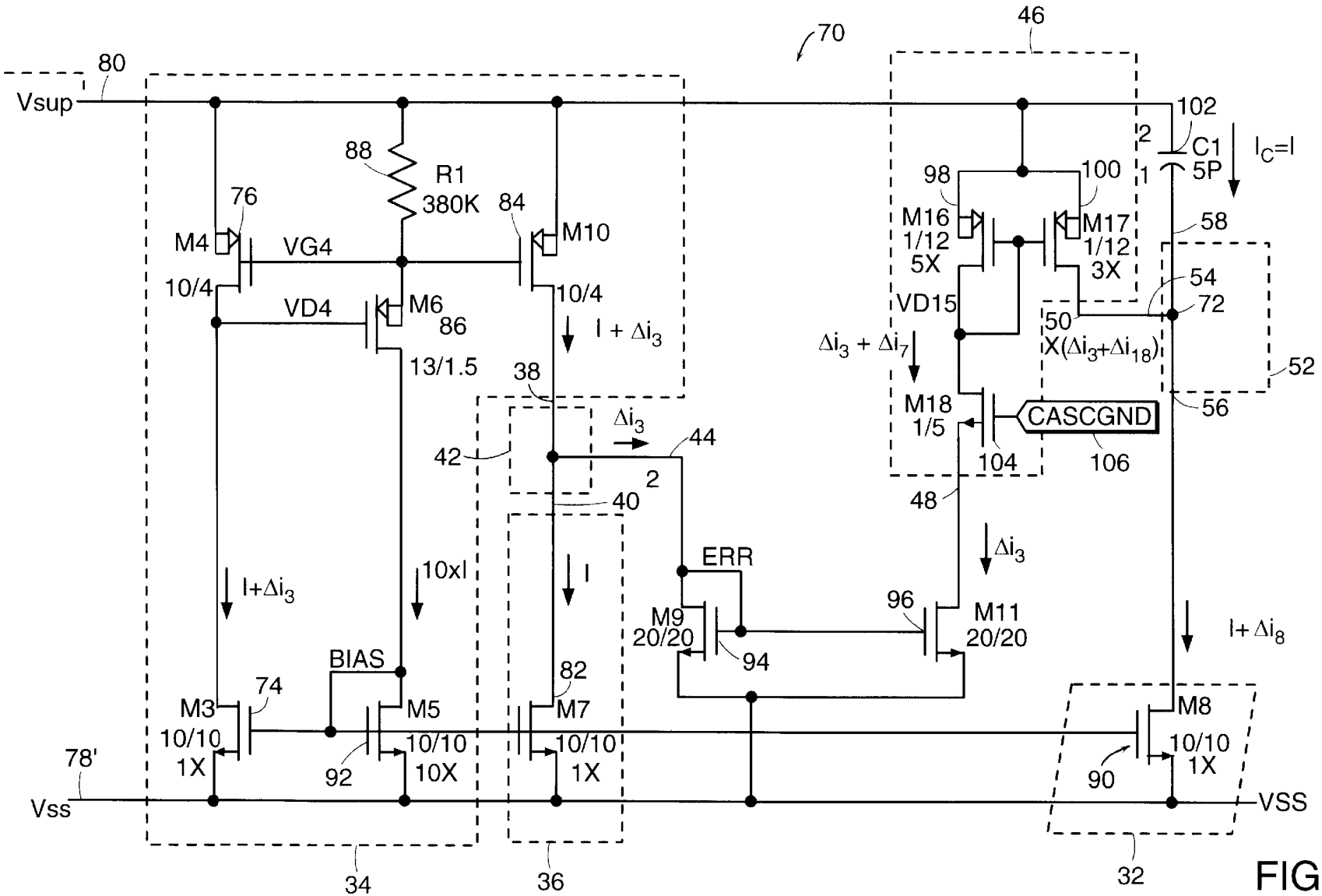
FIG. 4 is a schematic diagram of an embodiment of the circuit disclosed in FIG. 3.

Referring to FIG. 4, a circuit 70 for error current compensation constructed in accordance with the invention replicates the error current $\Delta i_8$ generated by MOSFET M8. The replicated error current tracks the actual value of the error current $\Delta i_8$ and is combined with the drain current Id of MOSFET M8 at node 72 to yield a stable current I through capacitor C1.

The circuit 70 includes MOSFET M3 74 having a drain connected to the drain of MOSFET M4 76 and a source connected to a voltage rail Vss 78. The source of MOSFET M4 76 is connected to a voltage rail Vsup 80. A MOSFET M7 82 has its source connected to rail Vss 78 and its drain connected to the drain of a MOSFET M10 84 whose source is connected to the rail Vsup 80. A MOSFET M6 86 has its source connected to Vsup 80 through a resistor R1 88 and its gate connected to the drain of MOSFET M4 76. The gates of MOSFET M4 76 and MOSFET M10 86 are connected together at the junction between resistor R1 88 and the source of MOSFET M6 86. A MOSFET M8 90 has its gate connected to the gate of MOSFET M7 82 and its source connected to rail Vss 78. A MOSFET M5 92 is connected by its source to rail Vss 78 and by its drain to the drain of MOSFET M6 86. The gate of MOSFET M5 92 is connected to the drain of MOSFET M5 92 and the gates of MOSFETs M3 74 and M7 82.

As a result of the configuration described above, the drain current flowing through MOSFET M3 74 is the mirror current of the drain current flowing through MOSFET M5 92. The magnitude of the mirror current through MOSFET M3 74 is approximately equal to the product of the drain current in MOSFET M5 92 and the ratio of the device sizes of MOSFETs M3 74 and M5 92. Similarly, the drain current flowing through MOSFET M7 82 is the mirror current of the drain current flowing through MOSFET M5 92. The magnitude of the mirror current through MOSFET M7 82 is approximately equal to the product of the drain current in MOSFET M5 92 and the ratio of the device sizes of MOSFETs M7 82 and M5 92. MOSFET M9 94 has its drain connected to its gate and the drains of MOSFETs M10 84 and M7 82. The source of MOSFET M9 94 is connected to rail Vss 78. MOSFET M11 96 has its gate and its source connected to the gate and source, respectively, of MOSFET M9 94. Consequently, the drain current in MOSFET M11 96 mirrors the drain current in MOSFET M9 94.

MOSFETs M16 98 and M17 100 are connected in a current mirror configuration with their sources connected to rail Vsup 80 and their gates connected to one another and the drain of MOSFET M16 98. The drain of MOSFET M17 100 is connected to the drain of MOSFET M8 90 and one terminal of capacitor C1 102 at node 72. The other terminal of capacitor C1 102 is connected to rail Vsup 80. The drain of MOSFET M16 98 is connected to the drain of cascode configured MOSFET M18 104 which has its gate connected to node CASCGND 106 which is a voltage node between Vss and Vsup. The source of MOSFET M18 104 is connected to the drain of MOSFET M11 96.

In operation, the current through MOSFET M7 82 is approximately equal to the current through MOSFET M3 74 because MOSFETs M7 82 and M3 74 are configured as a current mirror. However, the drain voltage on MOSFET M7 82 is clamped by MOSFET M9 94 to a voltage slightly greater than Vss while the drain voltage on MOSFET M3 74 is just slightly less than Vsup based on the two gate voltage drops of MOSFETs M4 76 and M6 86. MOSFET M3 74 conducts a current $I+\Delta i_3$ where $\Delta i_3$ is the additional current generated due to the relatively high drain voltage Vd on MOSFET M3 74. MOSFET M7 82 which operates at a substantially lower drain voltage Vd conducts a current I. The remainder of the mirrored current, equal to $\Delta i_3$, is conducted through MOSFET M9 94, thereby dividing the current $(I+\Delta i_3)$ from MOSFET M10 84 into two components, I through MOSFET M7 82 and $\Delta i_3$ through MOSFET M9 94. Because MOSFETs M9 94 and M11 96 are mirrored, a current $\Delta i_3$ is conducted through MOSFET M11 96.

The current $\Delta i_3$ through MOSFET M11 96 is equal to the current $(\Delta i_3+\Delta i_{18})$ through MOSFET M16 98, reduced by cascoded configured MOSFET M18 104. Because MOSFETs M16 98 and M17 100 are mirrored, the current through MOSFET M17 100 is $(\Delta i_3+\Delta i_{18})$. However because the device sizes of MOSFETs M16 98 and M17 100 are different, the current through MOSFET M17 100 is multiplied by a factor X and therefore is $X(\Delta i_3+\Delta i_{18})$. The factor X is determined by the ratio of the size of MOSFET M17 100 and the size of M16 98.

The current through MOSFET M8 90 is $(I+\Delta i_8)$ and is a mirror current to the current flowing through MOSFET M5 92. The error current $\Delta i_8$ results from the relatively high drain voltage Vd present on MOSFET M8 90. The sum of the currents into node 72 must be zero, therefore, the currents from MOSFET M17 100 and capacitor C1 102 must equal $(I+\Delta i_8)$. This relationship requires that $$(I+\Delta i_8)=X(\Delta i_3+\Delta i_{18})+Ic$$

where Ic is the current from capacitor C1 102. Therefore Ic is given by $$(I+\Delta i_8)-X(\Delta i_3+\Delta i_{18}).$$

If $X(\Delta i_3+\Delta i_{18})$ is chosen to be equal to $\Delta i_8$, then the current Ic is equal to I, the desired current, and is independent of the gate voltage Vg on MOSFET M8 90.

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method for compensating for a first error current generated by a current source, said method comprising the steps of:

generating a first current and said first error current;

generating a second current and a second error current, said second error current being substantially equal to said first error current;

generating a third current substantially equal to said first current;

extracting the second error current from said second current;

generating a multiplied current, said multiplied current comprising a scaled second error current and a multiplier error current; and combining said multiplied current, said first current and said first error current.

2. The method of claim 1 wherein said combining step comprises subtracting said multiplied current from said first current and said first error current.

3. The method of claim 1 wherein the step of generating a multiplied current occurs through a device which limits said multiplier error current.

4. The method of claim 3 wherein said device is a cascode device.

5. The method of claim 1 wherein said second current is generated by a current replica circuit.

6. An error compensating circuit for compensating for a first error current in a first current generated by a first current source, said error compensating circuit comprising:

a first current source having an output terminal, said first current source generating said first current and said first error current at said output terminal;

a second current source having an output terminal and generating a second current and a second error current, said second current being substantially equal to said first current and said second error current being substantially equal to said first error current;

a third current source having an output terminal and generating a third current, said third current being substantially equal to said first current;

a first subtractor having a first input terminal in electrical communication with said output terminal of said second current source, a second input terminal in electrical communication with said output terminal of said third current source and an output terminal, said first subtractor providing a first difference current at said output terminal of said first subtractor, said first difference current being substantially equal to said second error current;

a multiplier having an input terminal in electrical communication with said output terminal of said first subtractor and an output terminal, said multiplier generating a multiplied second error current and a multiplier error current at said output terminal of said multiplier, said multiplied second error current being a predetermined multiple of said second error current; and a second subtractor having a first input terminal in electrical communication with said output terminal of said first current source, a second input terminal in electrical communication with said output terminal of said multiplier and an output terminal, said second subtractor providing a second difference current at said output terminal of said second subtractor, wherein said second difference is substantially equal to said first current such that said first error current is substantially cancelled.

7. The error compensating circuit of claim 6 wherein said third current source comprises a clamped MOSFET device, said clamped MOSFET device substantially preventing generation of an error current at said output terminal of said third current source.

8. The error compensating circuit of claim 6 wherein said second multiplier comprises a cascode device.

9. The error compensating circuit of claim 6 wherein said multiplier comprises a plurality of components having a device size and wherein said predetermined multiple of said second error current is determined in response to said device sizes of said plurality of components.

* * * * *